US008577048B2

(12) United States Patent
Chaikin et al.

(10) Patent No.: US 8,577,048 B2
(45) Date of Patent: Nov. 5, 2013

(54) SELF-CALIBRATING LOUDSPEAKER SYSTEM

(75) Inventors: Peter Chaikin, Santa Monica, CA (US); Geoffrey Christopherson, Encino, CA (US); Brian Ellison, Salt Lake City, UT (US); John Lee, Salt Lake City, UT (US); Miguel Paganini, West Hills, CA (US); C. Rex Reed, Salt Lake City, UT (US); Timothy Shuttleworth, Oceanside, CA (US); Gregory Wright, Prior Lake, MN (US)

(73) Assignee: Harman International Industries, Incorporated, Northridge, CA (US)

( * ) Notice: Subject to any disclaimer, the term of this patent is extended or adjusted under 35 U.S.C. 154(b) by 865 days.

(21) Appl. No.: 12/065,479

(22) PCT Filed: Sep. 2, 2006

(86) PCT No.: PCT/US2006/034354

§ 371 (c)(1),
(2), (4) Date: Apr. 2, 2010

(87) PCT Pub. No.: WO2007/028094

PCT Pub. Date: Mar. 8, 2007

(65) Prior Publication Data

US 2010/0272270 A1 Oct. 28, 2010

Related U.S. Application Data

(60) Provisional application No. 60/713,669, filed on Sep. 2, 2005.

(51) Int. Cl.
*H04R 29/00* (2006.01)

(52) U.S. Cl.
USPC ..... 381/59; 381/58; 381/103

(58) Field of Classification Search
USPC ..... 381/58–59, 92, 103
See application file for complete search history.

(56) References Cited

U.S. PATENT DOCUMENTS

| | | | | |
|---|---|---|---|---|
| 6,243,260 | B1 * | 6/2001 | Lundgren et al. | 361/679.23 |
| 6,760,451 | B1 | 7/2004 | Craven et al. | |
| 2002/0067835 | A1 * | 6/2002 | Vatter | 381/58 |
| 2002/0154785 | A1 | 10/2002 | Pedersen | |
| 2003/0099365 | A1 * | 5/2003 | Karjalainen et al. | 381/61 |
| 2004/0247136 | A1 | 12/2004 | Wallace | |
| 2005/0078838 | A1 * | 4/2005 | Simon | 381/98 |
| 2006/0062398 | A1 * | 3/2006 | McKee Cooper et al. | 381/58 |
| 2006/0062399 | A1 * | 3/2006 | McKee et al. | 381/58 |
| 2006/0153391 | A1 | 7/2006 | Hooley et al. | |

FOREIGN PATENT DOCUMENTS

| | | |
|---|---|---|
| GB | 2 286 885 A | 8/1995 |

* cited by examiner

*Primary Examiner* — Disler Paul
(74) *Attorney, Agent, or Firm* — Brinks Hofer Gilson & Lione

(57) ABSTRACT

Systems and methods for calibrating a loudspeaker with a connection to a microphone located at a listening area in a room. The loudspeaker includes self-calibration functions to adjust speaker characteristics according to effects generated by operating the loudspeaker in the room. In one example, the microphone picks up a test signal generated by the loudspeaker and the loudspeaker uses the test signal to determine the loudspeaker frequency response. The frequency response is analyzed below a selected low frequency value for a room mode. The loudspeaker generates parameters for a digital filter to compensate for the room modes. In another example, the loudspeaker may be networked with other speakers to perform calibration functions on all of the loudspeakers in the network.

23 Claims, 13 Drawing Sheets

SELF-CALIBRATING LOUDSPEAKER SYSTEM

CROSS-REFERENCE TO RELATED APPLICATION

This application claims priority of U.S. Provisional Patent Application Ser. No. 60/713,669 filed on Sep. 2, 2005, titled "Self-Calibrating Loudspeaker," which is incorporated by reference in this application in its entirety.

FIELD OF THE INVENTION

This invention relates generally to audio speaker systems and more particularly to systems and methods for adjusting audio operating characteristics in one or more loudspeakers.

BACKGROUND

The performance of a loudspeaker is highly dependent on its interaction with the acoustics of its listening environment. Thus, a loudspeaker that produces a perceived high sound quality in one environment may produce a perceived low sound quality in a second environment. The differences in sound quality may be experienced within a room. The performance of a loudspeaker within a listening environment will interact differently with a room's acoustics when placed at different positions in the room. The performance of a loudspeaker will also be experienced differently from different listening areas within a room. Accordingly, different sound environments (or rooms), and changes in both the position of a loudspeaker and the listening area of the listener can alter perceived sound quality of a loudspeaker.

When a loudspeaker is used in a recording environment, the interaction of a loudspeaker with the recording environment affects the quality of the recorded sound. For example, loudspeaker monitors interact with the acoustics of the recording environment to create an inaccurate account of the audio at the mix position, which makes it challenging to create an audio mix that produces high quality sounds on all playback systems.

The manner and method of creating audio recordings has changed. First, recording and mixing audio on computers without the use of traditional audio mixing consoles is becoming more common. As a result, recording and mixing in non-traditional environments, such as bedrooms, basements, garages and industrial spaces (rather than in control rooms found in professional recording studios) is also becoming increasingly more common.

With the recent movement toward using computers for recording and mixing, a number of features and functionalities provided through the use of mixing consoles have been lost, such as full volume control from the mixing position and the ability to listen to multiple sources (e.g. 2 channel DAT, CD and the output of the recording system). Additionally digitization of the recording signal path has led to the use of digital inputs and outputs (I/O). While input/output ("I/O") boxes have been designed as the interface to computer recording systems they are not without limitations. For example, I/O boxes do not have input switching and many I/O boxes do not offer volume control. Those I/O boxes offering volume control only provide volume control for analog output. No volume control is provided for digital output. Further, many current I/O boxes are only capable of controlling stereo sound and cannot accommodate surround sound.

Through the use of computers for recording and mixing, both the size and price of recording equipment has been greatly reduced, which has created a movement toward recording and mixing in nontraditional environments. In these environments, working distances may be compromised and interference with loudspeaker performance by room acoustics may be greater, particularly in the low frequency range.

To optimize sound quality of loudspeakers in listening and recording environments, designers of loudspeaker have developed a number of different calibration systems and techniques to optimize loudspeaker performance in an actual acoustic environment. In general, most calibration systems involve adding equalizing filters or correction filters to optimize the low frequency response of a loudspeaker at a particular position in a particular listening environment.

One example of a calibration technique involves taking one or more types of acoustic measurements of a loudspeaker at different listening positions in both an anechoic room and the actual listening environment. Once sufficient measurements are recorded, filter correction coefficients are then derived by analyzing the listening room measurements against anechoic room measurements using different averaging and/or comparison techniques. Although the anechoic measurements for a particular loudspeaker, once recorded, may be stored for recall, all of the above calibration techniques require the acquisition of two separate sets of data—anechoic data and listening room data. All correction calculations are designed to adjust the performance of a loudspeaker in its listening environment to substantially match the performance of the loudspeaker in an anechoic environment.

While some methods compare anechoic data to measured data to calculate filter adjustments, at least one method exists for calibrating a loudspeaker to correct low frequency response in a listening room using only listening room measurements, i.e., the method does not utilize anechoic measurements. While this method does produce a noticeable increase in sound quality, the method involves manually plotting a number of recorded measurements and then analyzing and tabulating the charted results. The entire process takes time (in some examples, up to approximately thirty (30) minutes to complete) and requires the manual implementation of a number of steps. Not only is this calibration method cumbersome, but its success also depends on the absence of human error.

As illustrated above, current calibration techniques fail to provide a simplistic and/or completely automated method for optimizing loudspeaker performance in a particular listening environment based only upon the analysis of acoustic measurements of a loudspeaker in the listening room.

Further, most known calibration methods only correct for low frequency response. When more than one speaker is being used in a listening environment, other corrections may be necessary to create an accurate account of the audio at the listening or mix position. Unless the listening and/or mix position is located at a point equidistant to all speakers, adjustments may also need to be made to the performance of each loudspeaker so that, for example, all speakers contribute equally to the sound pressure level at the listening or mix position. Further, signal delays may need to be introduced so that the sound from all speakers reaches the mix/listening position at the same time. Generally, these types of corrections are made by manual adjustments to the loudspeakers performance (e.g. volume/signal delay). Thus, a need exists for a self-calibrating loudspeaker system capable of not only adjusting the low frequency response of each speaker, but also the sound pressure level and arrival time of each loudspeaker in the system at the listening and/or mixing point.

Although audio recording has changed over the last several years, the design, production and performance of loudspeakers have not been modified to account for the change. A need therefore exists for a loudspeaker and a loudspeaker system adapted for modern recording.

SUMMARY

In view of the above, systems consistent with the present invention include at least one loudspeaker capable of performing self-calibration for performance in a selected listening or recording environment without the need of any reference environment characteristics or data gathering in any other environment. In one example, the loudspeaker may be used in a network of loudspeakers positioned for operation in a selected listening or recording environment in which one of the loudspeakers, or a central control system, performs a calibration of each loudspeaker without the need for any reference environment characteristics or data gathering any environment.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

In the following description of preferred embodiments, reference is made to the accompanying drawings that form a part hereof, and which show, by way of illustration, specific embodiments in which the invention may be practiced. Other embodiments may be utilized and structural changes may be made without departing from the scope of the present invention.

I. Self-Calibrating Loudspeaker

Figure 1:
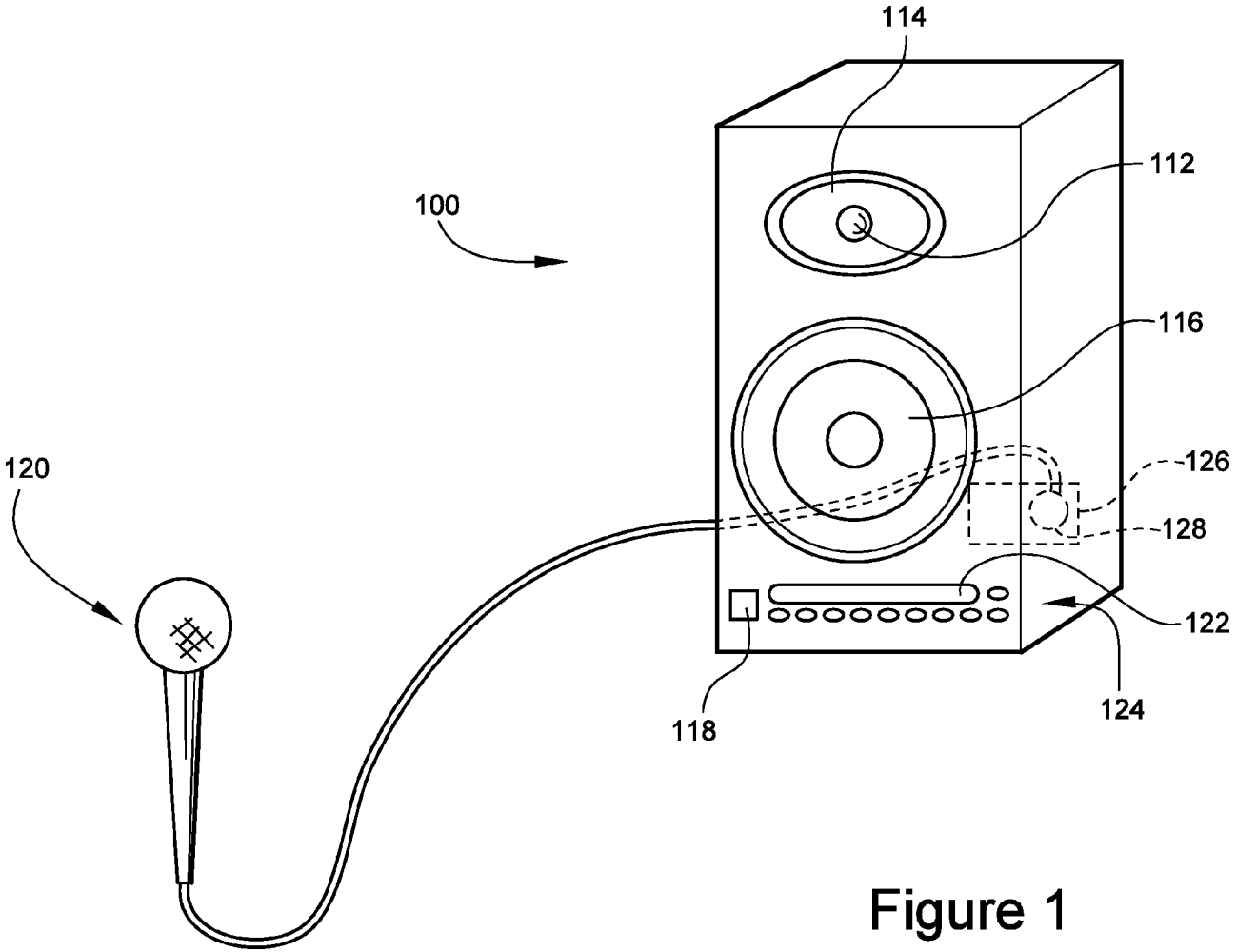
FIG. 1 is a block diagram of an example of a self-calibrating loudspeaker consistent with the present invention.

FIG. 1 is a block diagram of an example of a self-calibrating loudspeaker 100 connected to a microphone 120. The loudspeaker includes a high-frequency transducer 112, a waveguide 114, a low-frequency transducer 116, a power switch 118, a meter display 122, and a plurality of speaker function controls. The self-calibrating loudspeaker 100 in FIG. 1 includes an input/output panel 126, which includes a microphone input 128 to receive a connection to the microphone 120. The example self-calibrating loudspeaker 100 in FIG. 1 may include circuitry for performing functions for adjusting operating parameters to optimize performance in a given environment. The circuitry may be self-contained for full self-calibration capabilities, or may include an interface to other components for self-calibration as a system of loudspeakers. The other components may be other similar loudspeakers, or a component such as another loudspeaker or a system console that may provide central control over one or more other loudspeakers. The loudspeaker 100 in FIG. 1 may be used in a sound system for listening to audio, or in a recording studio for mixing audio in audio recordings. In examples of the loudspeaker 100 and other loudspeakers described below, functions and circuitry are included to optimize performance of the loudspeaker at a listening position for a sound system, and at a mixing position in a recording studio. Those of ordinary skill in the art will understand that the terms, "mixing position" and "listening position," are used interchangeably below. The listening position is also understood to mean a listening area since the use of multiple microphones may provide data for multiple positions within a room, and, because a single microphone may be used to take measurements from multiple positions in the room.

In one example, the loudspeaker 100 in FIG. 1 may use the microphone 120 to perform self-calibration functions. For example, the microphone 120 may be used to perform self-calibration functions associated with compensating for the detrimental effects of the geometry of the room or of having the loudspeaker 100 in a particular position in a room. One example of such self-calibration functions is room mode correction. When the loudspeaker 100 is placed in a room, the loudspeaker 100 and the room behave as a system that generates the sound heard at a listening position. The room geometry may lead to the formation of standing waves or room modes, and the position of the loudspeaker 100 may lead to activation of standing waves or room modes that can produce low frequency resonance. This low frequency resonance may give a misleading impression of bass and affect performance at the mixing position. Additionally, the speaker's proximity to boundaries such as walls, ceiling, floor or the work surface, may alter response when measured at the mix position. The effects produced are called "boundary conditions."

In an example of the loudspeaker 100 in FIG. 1, circuitry and software may be included to perform room mode correction. The room mode correction function analyzes response signals at the mixing or listening position and automatically applies filter settings to minimize low frequency resonance at the mix position, and/or to minimize the effect of boundary conditions. During the room mode correction process, a reference tone (or test sound) is emitted with the microphone 120 at the mix position and connected to the speaker. The reference tone is received by the microphone and measured by circuitry in the loudspeaker 100 configured to perform the room mode correction function. The computer measures the response received via the microphone, determines which if any conditions should be corrected, calculates and applies a corrective filter. The process may be initiated with the press of a button as described below, and in some examples may take a short period of time (e.g. a few seconds).

In some examples, more than one microphone may be used. The multiple microphones may be used, for example, to obtain data for other positions in a room, or to average data from multiple inputs.

One of ordinary skill in the art will appreciate that the two-way speaker illustrated in FIG. 1 is but one example of the type of loudspeakers that may be used in systems and methods consistent with the present invention. The loudspeaker 100 in FIG. 1 may also be a three-way speaker, a sub-woofer, or a loudspeaker having any other type of configuration.

Figure 2A:
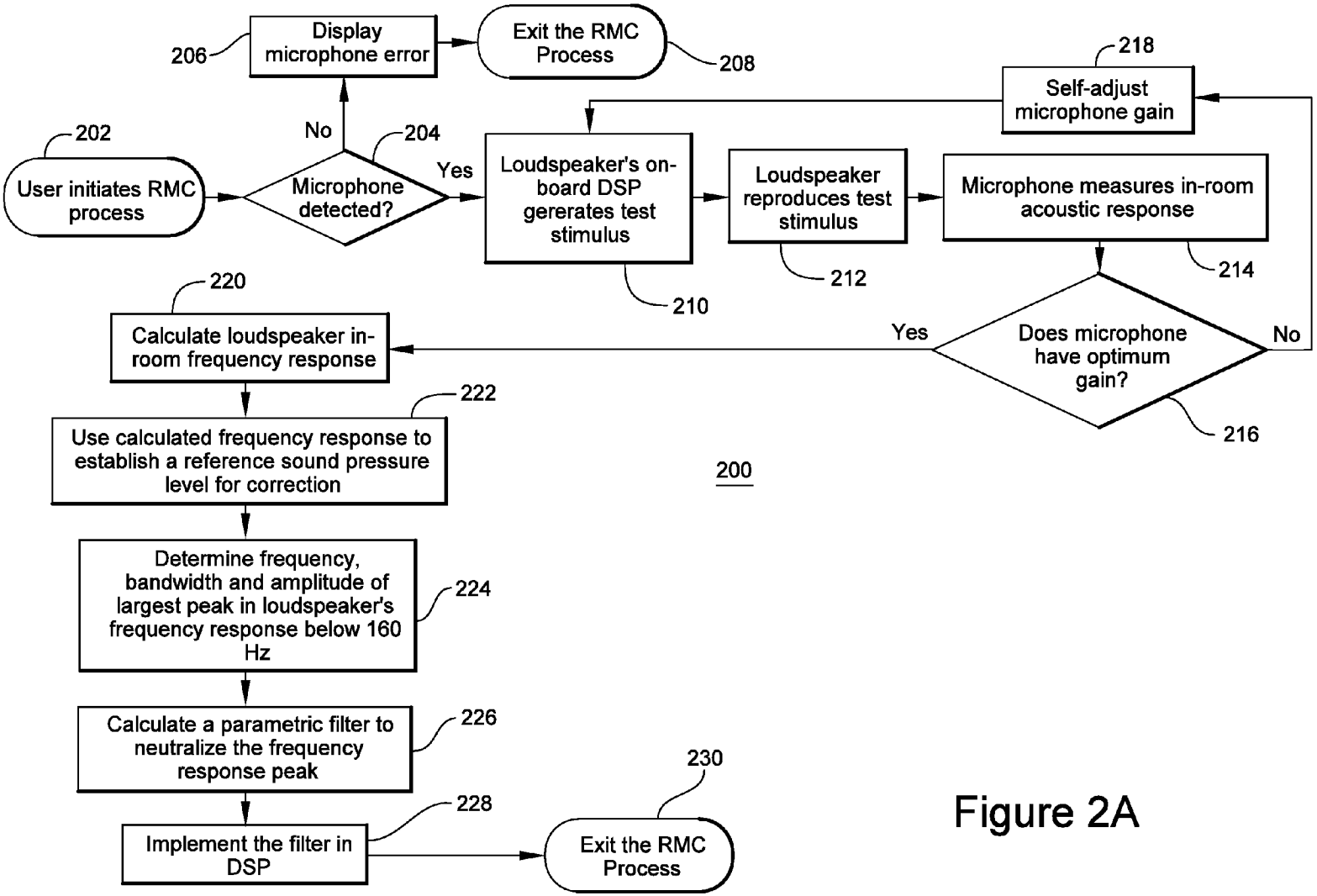
FIG. 2A is a flowchart of an example of a method for configuring an example of a self-calibrating loudspeaker for operation in a room.

FIG. 2A is a flowchart of an example of a method for configuring an example of a self-calibrating loudspeaker for operation in a room. The method 200 may be initiated by a user at step 202. In one example, the user presses a button on the loudspeaker 100 to initiate the method 200. In another example, the loudspeaker may be controlled via USB universal Serial Bus connection to a computer with control software, and include a wireless interface, such as an infrared (IR) port that may be used with a remote control device to initiate the method of FIG. 2A. The method 200 may include optional diagnostic steps, such as a check that the microphone 120 is connected at decision block 204. If the microphone 120 is not connected, the method 200 includes a step 206 of annunciating a microphone error by, for example, displaying the error at an indicator LED. The method 200 may then exit at step 208. If the microphone 120 is detected at decision block 204, another diagnostic step may involve a digital signal processor (DSP) generating a test stimulus at step 210. The loudspeaker 100 may then reproduce the test stimulus at step 212 for pickup by the microphone 120. The microphone 120 then measures the acoustic response of the test stimulus at step 214. At decision block 216, the microphone 120 checks whether it has an optimum gain. If the gain is inadequate, the microphone self-adjusts the gain at step 218 and the test stimulus is generated again at step 210. The process of adjusting the microphone 120 may be repeated until optimum.

Once the microphone has achieved an optimum gain, the method 200 proceeds to calculating the loudspeaker in-room frequency response at step 220. At step 222, the calculated frequency response is used to establish a reference sound pressure level for correction. At step 224, the method 200 determines the frequency, bandwidth, and amplitude of the largest peak in the loudspeaker's frequency response below 160 Hz. Room modes typically create resonance at specific frequencies and very narrow Q. Once the largest peak is identified, a high-precision parametric filter may be calculated to neutralize the peak at step 226. In one example, the parametric filter, may have 73 frequency centers between at $1/24^{th}$ octave centers, between 20 Hz and 160 Hz, with variable Q of 1.4 octave bandwidth to $1/11^{th}$ octave bandwidth and from 3 dB to 12 dB of attenuation. More than one parametric filter may be used in alternative examples.

The method 200 illustrated by the flowchart in FIG. 2A is one example of a method for performing self-calibration by the loudspeaker 100. Room mode correction is one example of a self-calibration function that may be performed by the loudspeaker 100. The method 200 illustrated in FIG. 2A may be performed by a loudspeaker control system contained in the loudspeaker 100. Alternatively, a separate component containing a processor and software for performing signal analysis, such as for example, a computer, or another loudspeaker may also perform the method 200 of FIG. 2A.

Figure 2B:
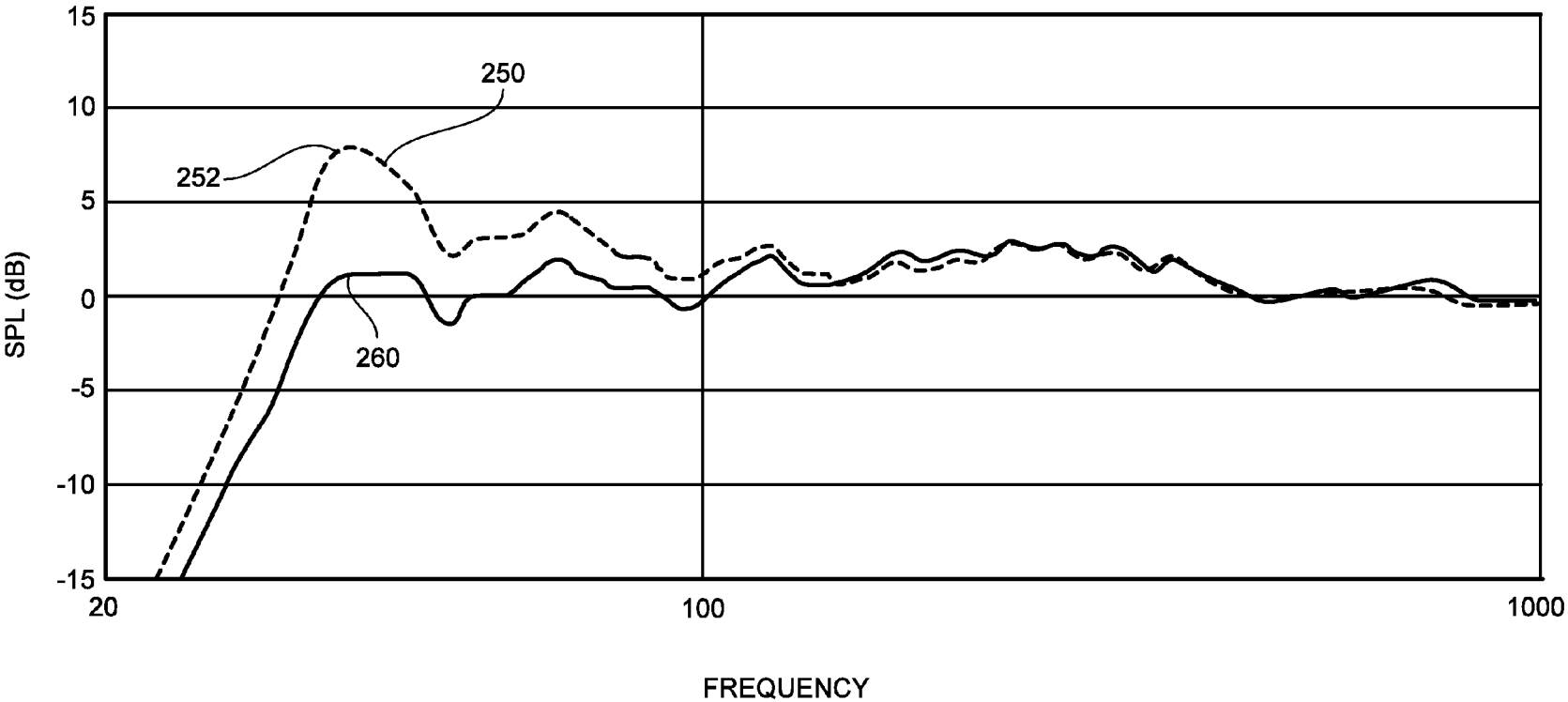
FIG. 2B is a diagram of frequency response curves illustrating the results of performing one example of a method for self-calibrating in a loudspeaker.

FIG. 2B is a graph of the frequency response of a loudspeaker system before performing self-calibration methods such as the one described above with reference to FIG. 2A and a graph of the frequency response of the loudspeaker system after having performed a method similar to the one described above with reference to FIG. 2A. The graph illustrates the frequency response of the loudspeaker system by plotting the sound pressure level (SPL) at each frequency in a range of to about 1000 Hz. A first frequency response curve 250 was generated without having performed any room mode correction. A second frequency response curve 260 was generated after having performed room mode correction. The first frequency response curve 250 includes a peak 252 created by resonance at that frequency due to the room geometry and/or the boundary conditions present at the loudspeaker. By performing an example of the method for configuring a loudspeaker described herein, the peak 252 was advantageously removed in the second frequency response curve 260.

Figure 3:
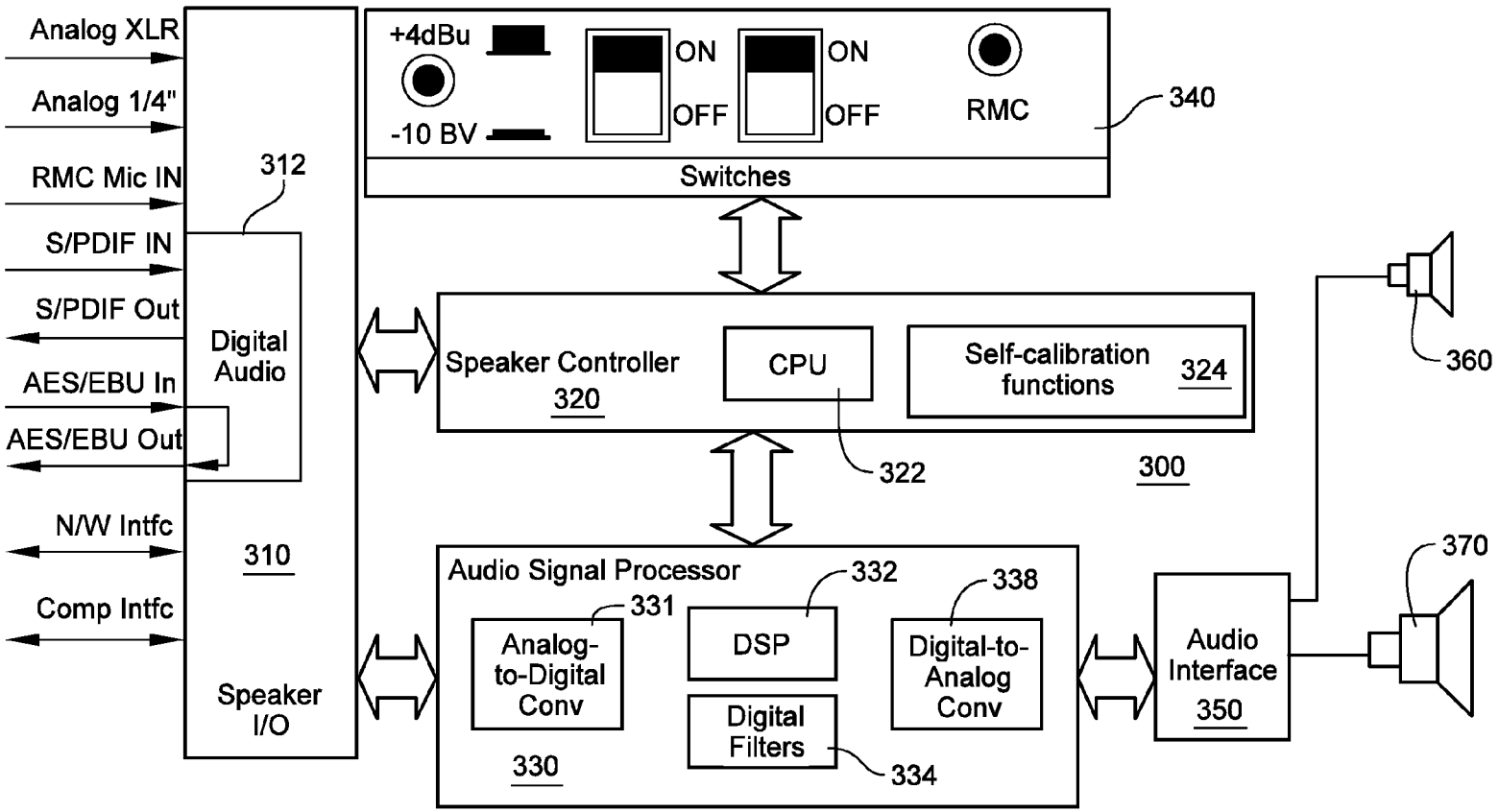
FIG. 3 is a block diagram of an example of a loudspeaker control system that may be used in the loudspeaker of FIG. 1.

FIG. 3 is a block diagram of an example of a loudspeaker control system 300 that may be used in the loudspeaker in FIG. 1 to perform self-calibration functions. The loudspeaker control system 300 in FIG. 3 includes a speaker input/output (I/O) block 310, a speaker controller block 320, an audio signal processor 330, a switch panel 340, and an audio interface 350 to speakers, which may include a high frequency speaker 360 and a low frequency speaker 370. Some or all of the components in the control system 300 in FIG. 3 may be mounted on a printed circuit board in a loudspeaker enclosure. The speaker I/O block 310 and the switch panel 340 may be mounted on a side of the loudspeaker 100 to provide a user access to the I/O connections and the switches. The speaker I/O block 310 and switch panel 340 may be part of a single panel of connectors and switches, or may be separately mounted panels.

The speaker I/O block 310 may include a panel with connectors for inputting audio signals received from the signal source as well as other types of signals, such as communications signals. The example control system 300 in FIG. 3 includes the following input and output signal types and connector types:

(1) Analog XLR connector
(2) Analog w/¼" connector
(3) Microphone input
(4) Digital S/PDIF input
(5) Digital S/PDIF output
(6) Digital audio IN based on the AES/EBU standard
(7) Digital audio OUT based on the AES/EBU standard
(8) A network interface for connecting a network of speakers
(9) A computer interface (e.g. USB)

Those of ordinary skill in the art will appreciate that the list of inputs and outputs is only an example of the types of connections that may be made to the loudspeaker 10. More or fewer may be used.

The switch panel 340 may include any type of switch that allows a user to initiate functions or adjust the configuration of the loudspeaker 100. For example, the following switches may be included:

(1) +4 dBu/−10 dBV Switch: In the OUT position, selects +4 dBU sensitivity for all analog inputs. In the IN position (when pressed) selects −10 dBV sensitivity for all inputs.
(2) Dipswitches: Used for digital audio (S/PDIF, AES/EBU) operation and for setting identifiers for speakers in a network (described in more detail below).

(3) RMC switch: initiates a room mode correction process when pressed by the user.

The inputs and outputs connected to the speaker I/O block 310 and the switches on the switch panel 340 may connect to a printed circuit board containing components of the control system 300 via any suitable connector. The connections may then be routed to hardware components configured to perform functionally as depicted by the block diagram in FIG. 3. The control system 300 includes a speaker controller 320 and an audio signal processor 330. The speaker controller 320 may include a central processing unit ("CPU") 322 such as a microprocessor, microcontroller, or a digital logic circuit configured to execute programmed functions. The functions may include self-calibration functions 324, which may include software programs stored in memory in the control system 300. The speaker controller 320 also includes known computer control functions to enable execution of programmed instructions used to perform self-calibration functions 324.

The audio signal processor 330 may include a digital signal processor (DSP) 332, an analog to digital converter 331, a set of digital filters 334, and a digital to analog converter 338. The audio signal processor 330 may also include additional circuitry to implement standard functions required by the use of, for example, digital AES/EBU standard digital audio or S/PDIF digital audio.

The audio signal processor 330 may output analog signals to an audio interface 350, which may include crossover networks to distribute high frequency signals to a high frequency speaker 360 and low frequency signals to a low frequency speaker 370, such as a woofer, or subwoofer.

The loudspeaker 100 described above with reference to FIGS. 1-3 may include built-in processing and operating capabilities for engaging in direct communication with other loudspeakers over a network without the use of any separate external hardware/software control mechanisms. Alternatively, the loudspeakers may be calibrated and controlled, entirely or partially, by external hardware/software controls or by both internal and external hardware/software modules. Control features provided by internal and external control modules may be inclusive and/or exclusive of one another when present in the system.

II. Network of Loudspeakers

The loudspeaker may provide for automated speaker calibration when used alone or as part of a network system. Each speaker may include the ability to automatically correct for low frequency response. When networked, automated calibration may include, but not be limited to, adjusting signal attenuation and/or gain of each loudspeaker so that the sound pressure level of each loudspeaker at the mixing/listening position is the same. Automated calibration may further include altering signal delay of each speaker so that sound output of each speaker arrives at the mixing/listening position at the same time. Accordingly, network speakers may compare recorded data, calculate delay and level trim to virtually position the all speakers in the system in a room, as well as adjust time of flight and output to balance and synchronize all of the loudspeakers at the listening/mix position.

A loudspeaker may be capable of self-calibrating for low frequency response and include networking capabilities that offer additional system calibration features and which may provide individual and/or system control through the loudspeakers, a remote control system or a software control program. The system of loudspeakers may be configured in a variety of ways including known standard configurations such as stereo, stereo surround (e.g. 5.1, 6.1, 7.1, etc.), as well as any other desired configuration of full range speakers and subwoofers. In one example system, up to 8 full-range speakers and two subwoofers may be networked for calibration.

A. Calibrating Speakers in a Network of Speakers

The speakers may be placed in network communication with one another, for example, by connecting them directly to one another in series or in parallel to a "master" speaker. When using a central software control system, the speakers may be connected in series to the control system, or all the speakers may, for example, be connected in parallel with the control system. When using a software control system, the software control system may be designed to initiate and control system calibration functions. Alternatively, each speaker may include digital signal processing capabilities and a controller to initiate and perform speaker calibration.

To calibrate the speakers, a microphone is connected to at least one speaker and represents the listening/mixing position. When a microphone is connected to only one speaker in the system, the system may include a function that detects the speaker to which the microphone is connected, or require that the microphone be connected to a certain speaker, e.g., the "master" speaker. In certain implementations, one speaker must be designated as the "master" and is responsible for initiating and control the calibration process.

Once the microphone is connected to a speaker and placed at the desired mixing/listening position, calibration may be initiated either through a user interface physically located on the loudspeaker, through remote control, or through the control system. Each speaker may include one or more network connections for networking the speakers to one another or to a control system. Each speaker may also include one or more interface ports, including, but not limited to, serial, parallel, USB, Firewire, LAN or WAN interface ports, for interfacing with a control system or other device.

Figure 4A:
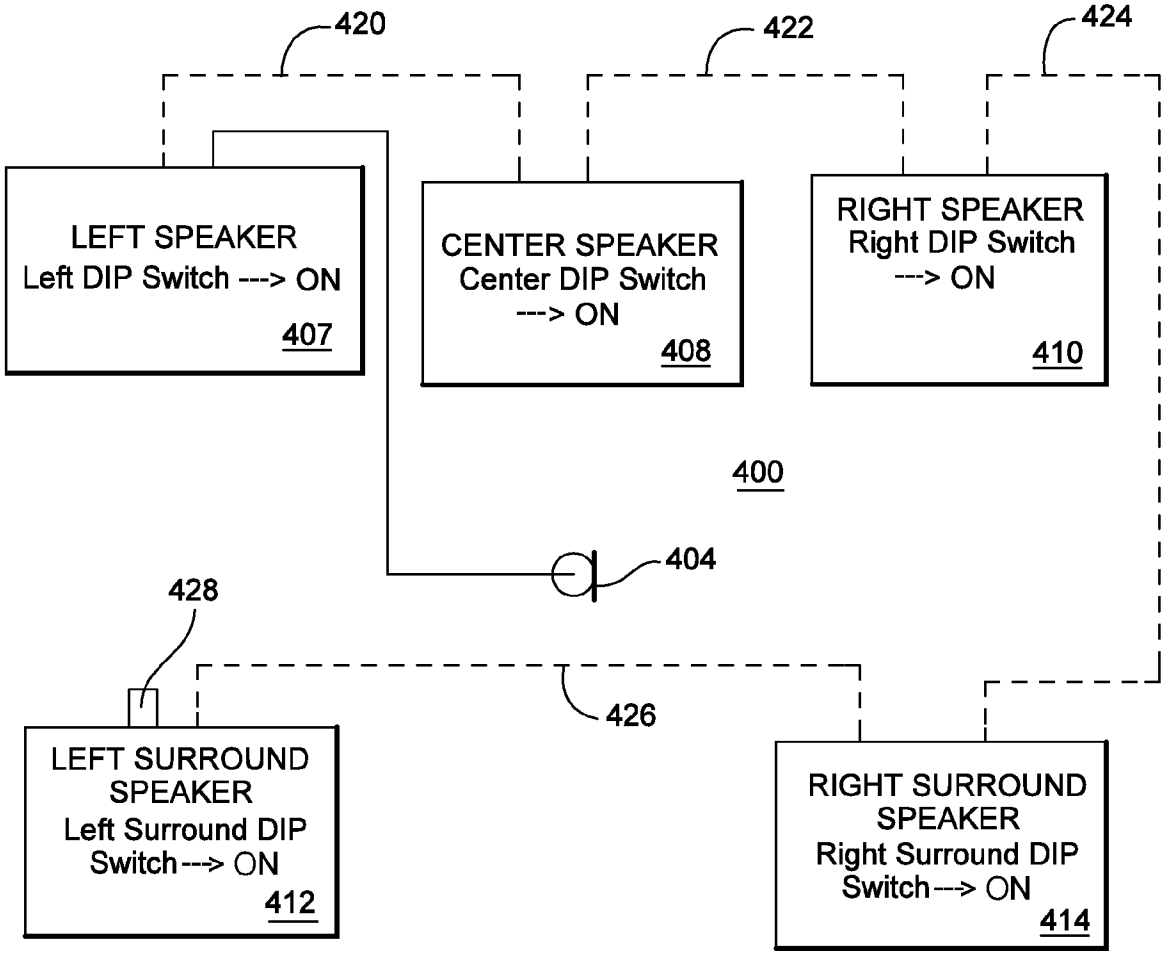
FIG. 4A is a block diagram of an example of a system of self-calibrating loudspeakers consistent with the present invention.

FIG. 4A is a block diagram illustrating one example of a system of self-calibrating loudspeakers 400 as described above. The system 400 includes a left speaker 402, a center speaker 408, a right speaker 410, a left surround speaker 412, and a right surround speaker 414. The speakers are connected to each other by a communications link, which may include any standard, proprietary or other form of digital communication. A microphone 404 is connected to the left speaker 410. The left speaker 402 performs as the master speaker in the example in FIG. 4A.

The speakers 402, 408, 410, 412, 414 may be similar to the loudspeaker 100 described above with reference to FIGS. 1-3. Each of the speakers 402, 408, 410, 412, 414 in FIG. 4A includes two network interface plugs to receive cables with connectors. The example speakers 402, 408, 410, 412, 414 in FIG. 4A use CAT5 cables for communication and implement RJ45 connectors as the two network interface plugs.

The communications link shown in FIG. 4A is a first CAT5 cable 420 between the left speaker 402 and the center speaker 408, a second CAT5 cable 422 between the center speaker 408 and the right speaker 410, a third CAT5 cable 424 between the right speaker 410 and the right surround speaker 414, and a fourth CAT5 cable 426 between the right surround speaker 414 and the left surround speaker 412. An Ethernet terminator 428 is plugged into the final RJ45 connector in the left surround speaker 412. In other examples of a network of speakers, an Ethernet terminator 490 may not be needed. In other examples, the speakers 402, 408, 410, 412, 414 may include alternative network connections.

Figure 4B:
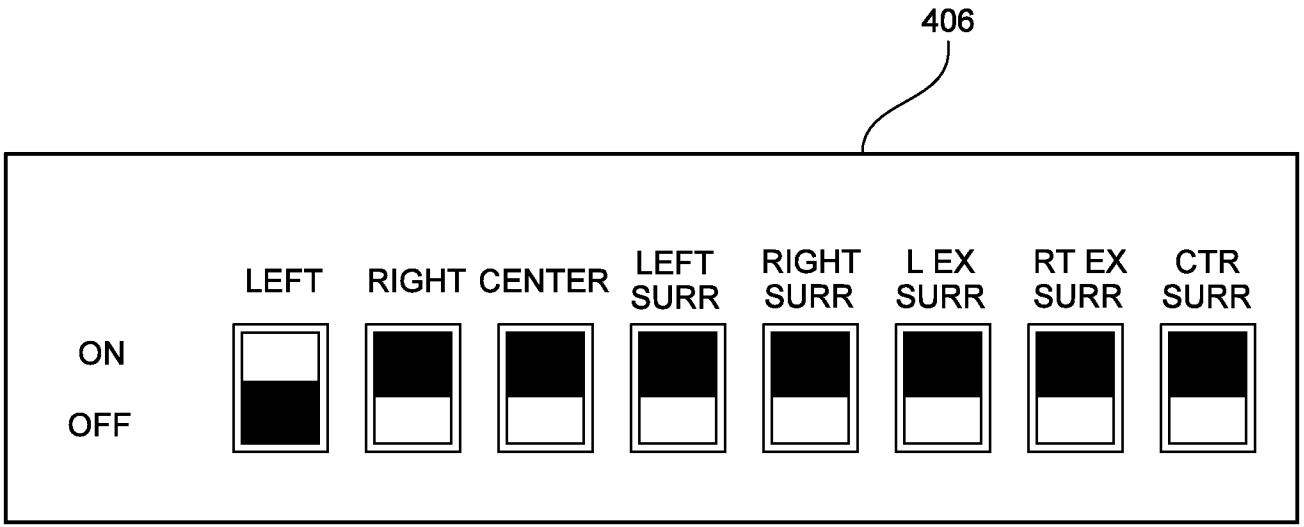
FIG. 4B is a diagram of an example of a dipswitch that may be used to identify one of the loudspeakers in FIG. 4A.

When used in a network, each speaker may be identified by its position in the system, such as left, right, center, etc. In the case of stereo sound, speaker identification determines which channel of digital stream (A or B) the speaker monitors. Speaker identification can be assigned via hardware or software. Each of the speakers 402, 408, 410, 412, 414 in FIG. 4A includes a set of dipswitches for identifying the speaker uniquely in the network. FIG. 4B is a schematic diagram of an 8 dipswitch block 406 that may be included in each speaker to identify that speaker in the network of speakers 400 in FIG. 4A. The eight dipswitch block 406 includes switches labeled according to an example of a function that speaker might serve in an audio system. In order to identify a speaker, the individual switch identifying that speaker's function in the dipswitch 406 for each speaker is set to 'ON' and the rest of the switches are set to 'OFF.' For example, a system involving more than one speaker may be a stereo system, which would include a left speaker and a right speaker. Once the speakers are located in a room, a user may set the dipswitch on each speaker to identify it in the network of speakers. The first two switches in the dipswitch block 406 permit identification of a left and a right speaker. The "LEFT" switch on the dipswitch 406 in the left speaker is set to 'ON' to identify that speaker as the left speaker. The "RIGHT" switch on the dipswitch 406 in the right speaker is set to 'ON' to identify that speaker as the right speaker. Similarly, if a center speaker is added, the "CENTER" switch on its dipswitch 406 is set to 'ON' to identify it as the center speaker. The dipswitch 406 in FIG. 4B identifies other functions that a speaker may play in a sound system, such as, left surround (LEFT SURR), right surround (RIGHT SURR), left extra surround (L EX SURR), right extra surround (RT EX SURR), and center surround (CTR SURR).

Those of ordinary skill in the art will appreciate that the dipswitch and identifying scheme used in the system 400 of FIG. 4A is one example of a way of identifying the speakers in a sound system. Others may be used as well. In an alternative example, dipswitches are not used. A hardwired (e.g. address set by cutting jumpers), or an address burned in memory in the speaker, or an assigned identifier stored in RAM in each speaker may be used to identify the speakers.

Referring back to FIG. 4A, an example of a system of speakers 400 for calibrating the speakers for operation in a room may initiate the calibration of the system by a user initiating a room mode correction function. In the example shown in FIG. 4A, a user may press a room mode correction function button on the left speaker 402, which includes the connection to the microphone 406. In the example in FIG. 4A, the left speaker 402 operates as a "master" speaker in performing room mode correction. That is, the left speaker 402 executes the functions required to calibrate each speaker in the system of speakers and controls operation and configuration of the other speakers by communicating over the network connection between the speakers. Those of ordinary skill in the art will appreciate that the system 400 in FIG. 4A is one example of a system for calibrating a network of speakers. In alternative examples, another speaker may be the "master" speaker, or the speakers may implement a handshaking system where each speaker self-calibrates and hands off to the next speaker until each speaker has self-calibrated.

After the user initiates a room mode correction, the left speaker 402 in FIG. 4A may initiate a self-calibration process by emitting a reference signal to calculate a frequency response. The speaker 402 may then analyze the frequency response to identify the peaks in the low frequency range and configure a set of parametric filters to neutralize the peaks in the low frequency range. The left speaker 402 may perform any other calibration functions. For example, one calibration function that may be performed is a virtual positioning function in which a delay is calculated for the signal at each speaker and inserted into the signals so that the speakers appear to sound equidistant from the microphone. Another calibration function includes calculating a signal attenuation required to have all of the speakers generate an equal sound pressure level at the microphone. Other calibration functions may be implemented and performed by the left speaker 402, or by the designated "master" speaker.

Adjustment for low frequency response, sound pressure level and impulse response are only examples of various types of calibration functions that may be automated via network communication as described in the example shown in FIG. 4A. Other calibration functions and/or relative speaker adjustments may also be automated as desirable or necessary to optimize sound quality of a loudspeaker system.

Figure 4C:
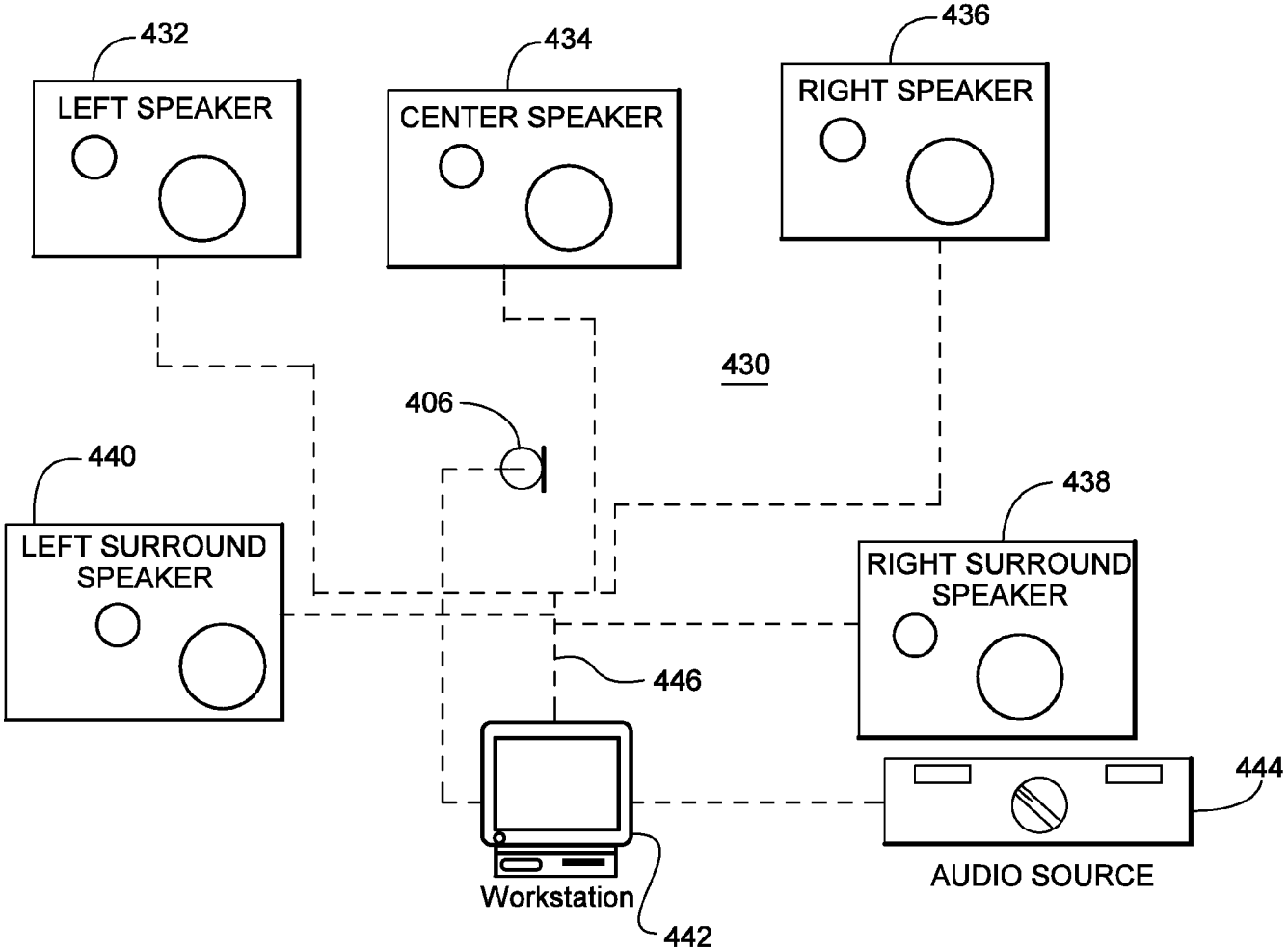
FIG. 4C is a block diagram of another example of a system for calibrating loudspeakers.
Figure 4D:
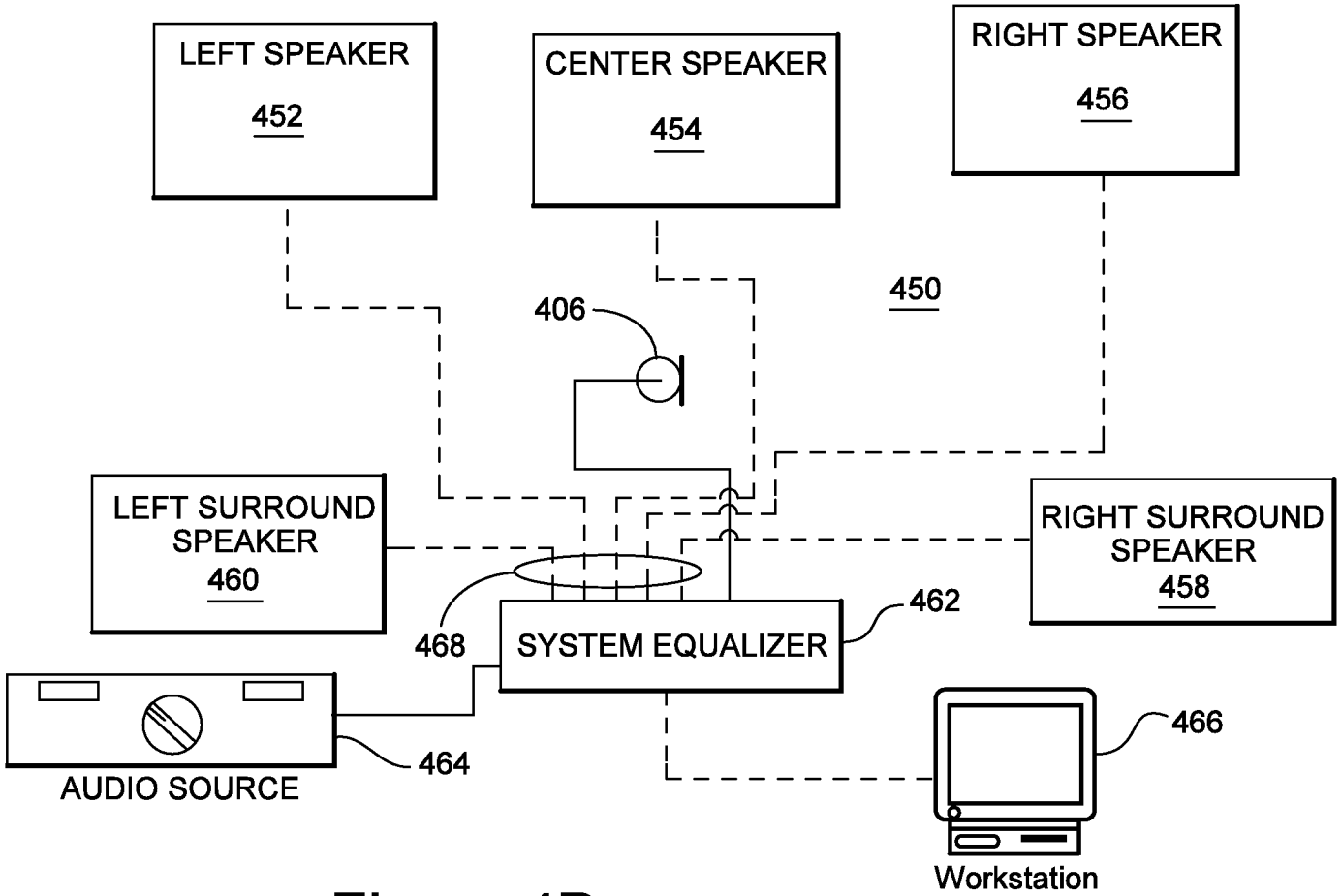
FIG. 4D is a block diagram of another example of a system for calibrating loudspeakers.
Figure 4E:
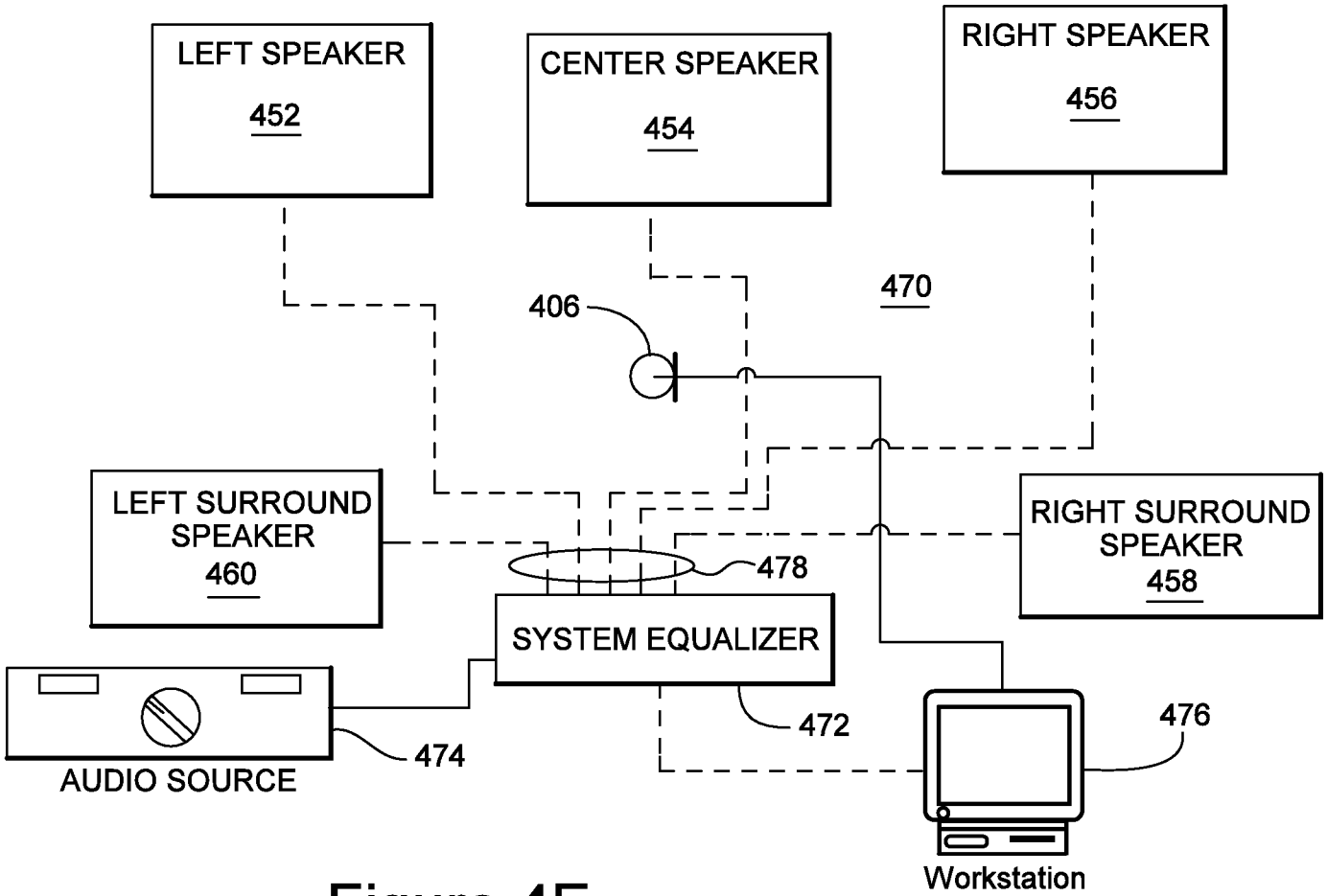
FIG. 4E is a block diagram of another example of a system for calibrating loudspeakers.

Examples of systems for calibrating and/or configuring a network of loudspeakers that have been described above with reference to FIG. 4A implement loudspeaker control systems mounted within the loudspeaker enclosure of one or more of the loudspeakers in the network. In alternative examples of systems, the loudspeaker control systems may be within a separate control unit. FIGS. 4C, 4D and 4E illustrate examples of control systems external to the loudspeaker that advantageously distribute functions for calibrating and configuring the loudspeakers and for delivering audio to the loudspeakers.

FIG. 4C shows a network of loudspeakers 430 that includes a left loudspeaker 432, a center loudspeaker 434, a right loudspeaker 436, a right surround speaker 438, and a left surround speaker 440. The loudspeakers 432, 434, 436, 438, 440 are connected to a workstation 442 via a network 446. An audio source 444 may be connected to the workstation 442 to generate audio signals to send to the loudspeakers 432, 434, 436, 438, 440. In the system 430 in FIG. 4C, the workstation 442 is connected to each speaker using, for example, a sound card. In performing a calibration involving room mode correction, for example, the workstation 442 may generate the calibration tone. The microphone 406 in FIG. 4C is connected to the workstation 442, which processes the test signals received from the speakers via the microphone 406. The workstation 442 then processes the calibration audio signals.

The workstation 442 may implement the filters that provide correction for the room modes as it processes audio from the audio source 444. This allows for implementation of calibration of the loudspeakers without requiring a dedicated interface into the internal circuitry of the loudspeakers. In addition, if the workstation 442 is also an audio source and the external audio source 444 shown in FIG. 4C is not used, the system for calibrating the loudspeakers 430 may be provided as a software "plug-in" for universal use with any network of loudspeakers. Alternatively, the workstation 442 may have access to and implement the digital filters in the loudspeakers 432, 434, 436, 438, 440.

FIG. 4D is another example of a system for configuring or calibrating a network of loudspeakers 450 that includes a left loudspeaker 452, a center loudspeaker 454, a right loudspeaker 456, a right surround speaker 458, and a left surround speaker 460. The loudspeakers 452, 454, 456, 458, 460 are connected to a system equalizer 462 via audio cables 468. The workstation 466 may be connected to the system equalizer 462 via a standard network connection (e.g. USB, Firewire, etc.). An audio source 464 may be connected to the system equalizer 462 to generate audio signals to send to the loudspeakers 452, 454, 456, 458, 460. In the system 450 in FIG. 4D, the system equalizer 462 includes a connection to at least one microphone 406. The system equalizer 462 may generate a calibration signal to each of the loudspeakers 452, 454, 456, 458, 460 to output, and receive the test signal from the microphone 406. The system equalizer 462 may also include software to analyze, to process and to correct audio signals. For example, the system equalizer 462 may include software to perform room mode correction, virtual positioning and sound attenuation described below with reference to FIG. 7. The system equalizer 462 may also implement digital filters to correct for any room modes, boundary conditions or other anomalies found. As such, the system 450 in FIG. 4D may be used with any loudspeaker. The system equalizer 462 may also receive audio signals from the audio source 464, or from the workstation 466. The workstation 466 may also include control software with a graphical user interface ("GUI") (described below with reference to FIG. 4F) to control operation of the calibration software in the system equalizer 462.

FIG. 4E is another example of a system for configuring or calibrating a network of loudspeakers 470 that includes the left loudspeaker 452, the center loudspeaker 454, the right loudspeaker 456, the right surround speaker 458, and the left surround speaker 460 similar to the system 450 in FIG. 4D. The loudspeakers 452, 454, 456, 458, 460 are connected to a system equalizer 472 via audio cables 478. The workstation 476 may be connected to the system equalizer 472 via a standard network connection (e.g. USB, Firewire, etc.). In FIG. 4E, the microphone 406 is connected to the workstation 476. The workstation 476 may therefore include software to determine required correction of audio signals. For example, the workstation 476 may include software to determine what is required to perform room mode correction, virtual positioning and sound attenuation described below with reference to FIG. 7. The workstation 476 may also communicate parameters to the system equalizer 472 to implement digital filters to correct for any room modes, boundary conditions or other anomalies found and perform virtual positioning and attenuation. An audio source 474 may be connected to the system equalizer 472 to communicate audio signals to the speakers 452, 454, 456, 458, 460. Alternatively, the workstation 476 may be the audio source. In one example, the workstation 476 is the audio signal source with a USB or Firewire over audio connection.

Figure 4F:
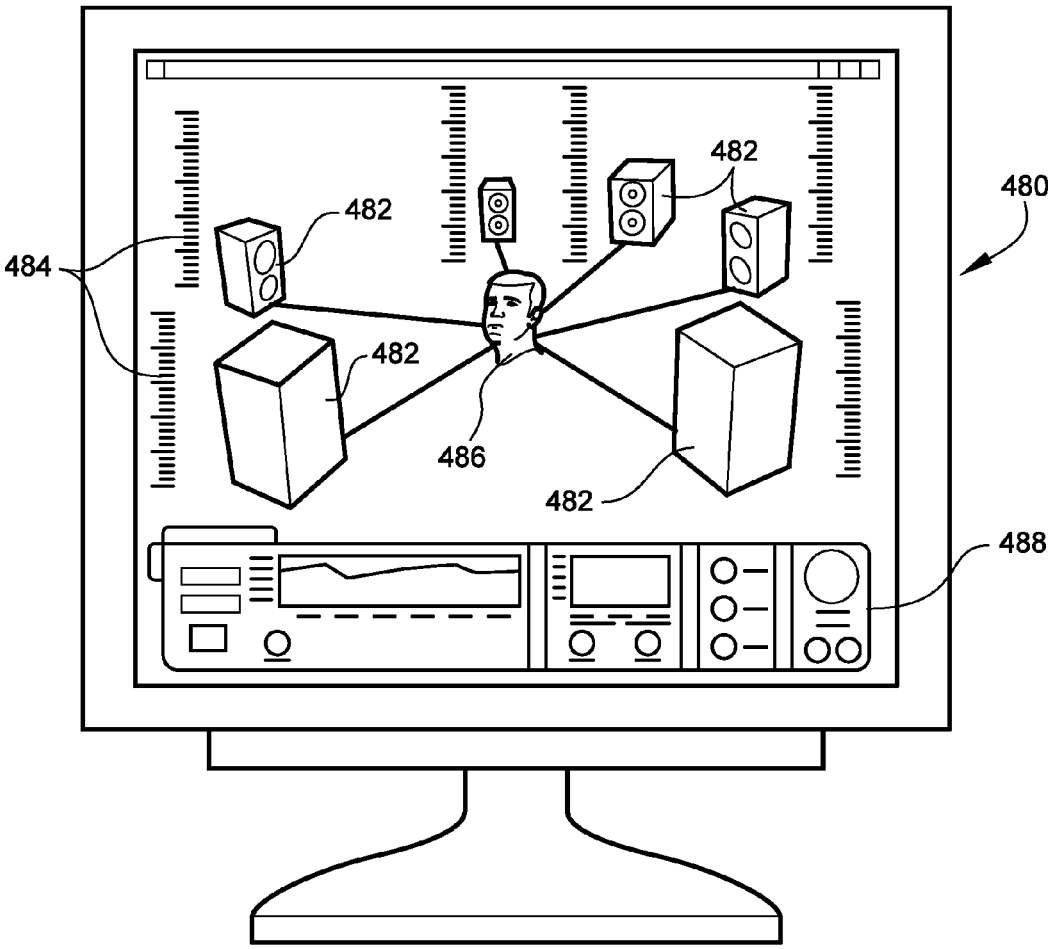
FIG. 4F is an illustration of an example of a user interface that may be used in a computer program in another example of a system for calibrating loudspeakers.

FIG. 4F is a GUI 480 that may be used on a workstation, such as the workstation 466 in FIG. 4D or the workstation 476 in FIG. 4E to control software on either system equalizer (462 or 472 in FIG. 4D or 4D, respectively). The GUI 480 shows a graphical representation of the speakers 482 with corresponding meters 484 next to each speaker 482. A listening/mixing position 486 is represented graphically. The graphical representation of the speakers 482 may graphically represent a scaled image of the positions of the speakers relative to each other and to the listening/mixing position 482 based on the distance of the speakers to the listening mixing position 486 as calculated as described below with reference to FIG. 7. A graphical representation of the control panel 488 may provide the user with an interface to perform calibration and configuration functions from the workstation 466, 476 (FIGS. 4D, 4E respectively).

While any method or technique for calibrating loudspeakers may be implemented, the loudspeaker and loudspeaker system may utilize an automated method for adjusting low frequency response. The method may include (i) recording the in-room acoustic response of the loudspeaker at the mixing/listening position, (ii) calculating the in-room frequency response, (iii) establishing a reference sound pressure level using the calculated in-room frequency response, (iv) determining frequency bandwidth and amplitude of the largest peak in the loudspeakers frequency response below a predetermined frequency; (v) calculating a parametric filter to neutralize the frequency response peak; and (vi) implementing filter correction.

Similarly, any method or technique may be used to adjust volume and synchronize the arrival of sound of networked loudspeakers at the mixing/listening position. By way of example, sound arrival at the mixing position may be synchronized by (i) calculating impulse response for each network speaker at the mixing position; (ii) determining each speaker's distance from the mixing position, and (iii) calculating signal delay required for each speaker to sound as though the speakers are positioned equidistant from the mixing/listening position. In another example, the volume of each speaker at the mixing position may be equalized by determining the sound pressure level of each speaker at the mixing position and calculating the amount of signal attenuation and/or gain adjustment required to have all speakers contribute equal sound pressure levels at the mixing position.

Each loudspeaker may further include both analog and digital inputs of various types (e.g. S/PDIF and AES/EBU). By allowing the receipt of different input types, the system is able to provide different outputs and operate in both stereo and surround sound. The system may also switch between analog inputs and digital inputs to monitor, for example, the output of the recording system, a DVD player and/or the output of multi-channel encoder/decoder or processor.

B. Loudspeaker Control System in a Network of Loudspeakers

Figure 5:
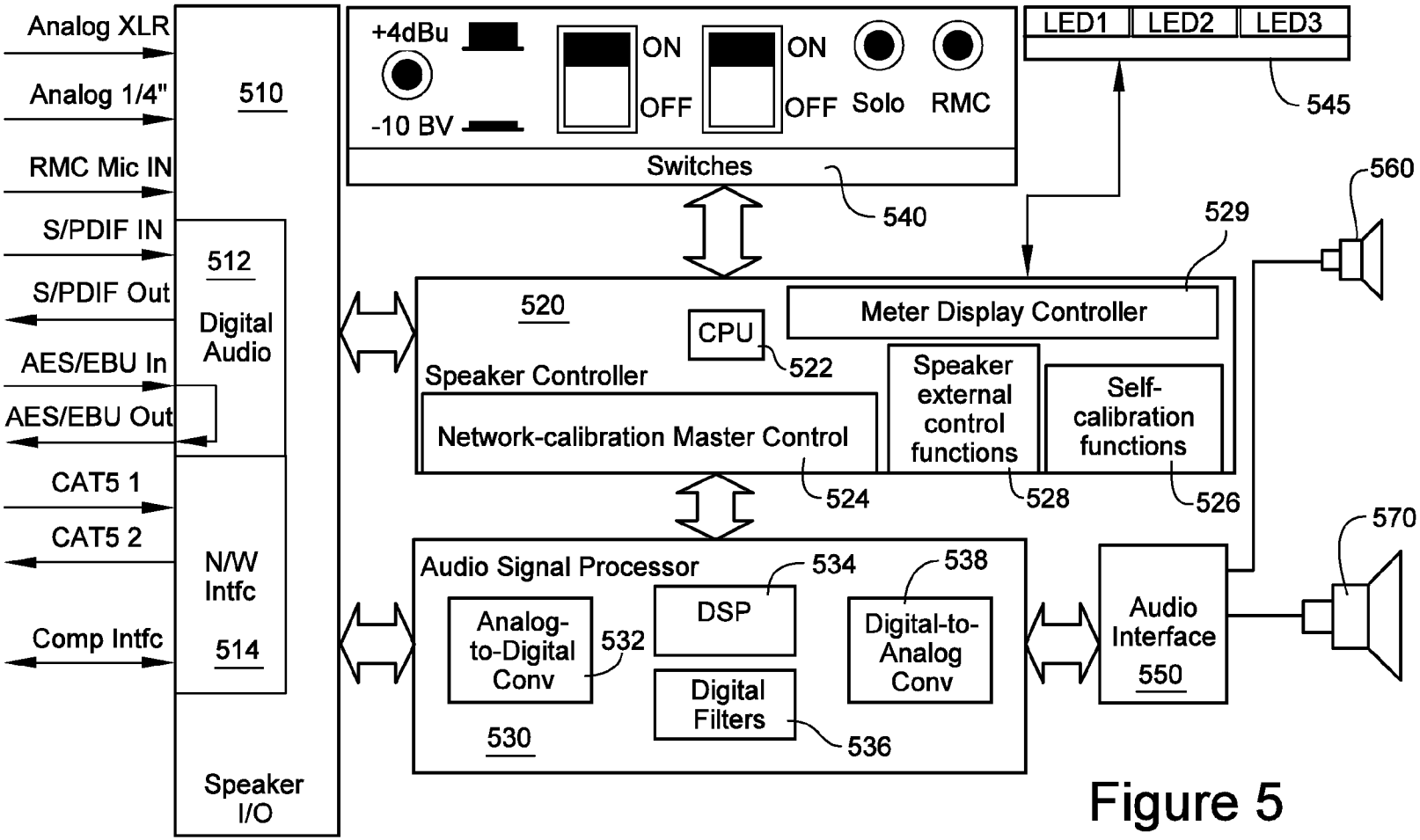
FIG. 5 is a block diagram of a loudspeaker control system that may be implemented in a speaker in FIG. 4A.

FIG. 5 is an example of a loudspeaker control system 500 of the type that may be used in a loudspeaker in a system for calibrating a network of loudspeakers such as the system shown in FIG. 4A. The loudspeaker control system 500 includes circuitry and functions that enable it to perform calibration of multiple speakers in a network of speakers. Those of ordinary skill in the art will appreciate that the loudspeaker control system 500 in FIG. 5 may be used as in a loudspeaker to perform a self-calibration such as for example, the method of self-calibration described above with reference to either FIG. 2 or FIG. 3.

The loudspeaker control system 500 in FIG. 5 includes a speaker I/O block 510, a speaker controller 520, an audio signal processor 530, a switch panel 540, a meter display 545, an audio interface 550, and a set of speakers including, for example, a high-frequency speaker 560 and a low frequency speaker 570. The speaker I/O block 510 may include inputs and outputs such as any of the inputs/outputs described above with reference to FIG. 3. The speaker I/O block 510 may include a digital audio block 512 to process digital audio signals such as, for example, standard digital audio signals according to the S/PDIF or AES/EBU standards. The speaker I/O block 510 may also include wired or wireless network interfaces to permit communication among the speakers over a communications link. The example in FIG. 5 includes two CAT5 connections to a network interface 514. Those of ordinary skill in the art will appreciate that any network connection may be used. Examples include serial, parallel, USB, Firewire™, LAN or WAN connections, or Wi-Fi, Bluetooth, infrared, 802.11 or other types of wireless communication. Information may be routed through the network using known communication protocols, such as TCP/IP, or proprietary protocols. The network interface 514 may operate according to the Harman HiQNet™ protocol, or any other suitable protocol.

The switch control block 540 may include switches included in the speaker control system 300 of FIG. 3. In addition, the switch panel may include dipswitches such as the dipswitch block 406 of FIG. 4B. The dipswitch block 406 may perform additional functions when not calibrating the speakers. For example, when receiving digital audio signals, a user may designate specific speakers to receive a specific channel in the digital signal. Each speaker receives the same S/PDIF signal, for example. A user may designate certain speakers to process channel A and others to process channel B.

The RMC button may also be included to initiate a room mode correction function for the speakers as a network. The speaker whose RMC button is pressed may initiate the room mode correction process and be a "Master," or hand off the job of a "Master" to another speaker.

The meter display 545 in FIG. 5 is a series of LEDs (LED1, LED2, LED3) each in the shape of a rod attached to each other end-to-end and extending length across a panel of the loudspeaker. The meter display 545 includes a meter display driver, which receives signals from the speaker controller 520 and illuminates a LED or series of LEDs in accordance with a signal level, or other indication from the speaker controller 520.

In support of the ability to provide speaker calibration, the speaker controller 520 may include a CPU 522, network calibration master control functions 524, self-calibration functions 526, speaker external control functions 528, and a meter display controller 529. The speaker network calibration control functions 524 in one example of the loudspeaker control system 500 controls a process for calibrating the speakers in a network. The network calibration master control functions 524, self-calibration functions 526, and speaker external control functions 528 may be programmed into memory accessible to the CPU 522 during execution of programmed instructions. The memory may be of any type suitable, or fitted, for use in a loudspeaker environment, including ROM, RAM, EPROM, disk storage devices, etc.

The functions may include:

(1) Speaker identification functions: the speaker may scan for other speakers on the network and identify each speaker.

(2) Microphone diagnostic functions: the speaker may test the microphone presence and gain before calibrating each speaker.

(3) Master Room Mode Correction functions: the speaker may receive signals generated by another one of the speakers on the network via the microphone and perform signal analysis required for room mode correction, or other calibration functions to determine settings for the other one of the speakers being calibrated.

(4) Auto Level Trim—Speaker levels are trimmed in X dB increments (e.g. ¼ dB increments) so all speakers on in the system area produce equal SPL (sound pressure level) at the mix position.

(5) Virtual Positioning™ The distance of each speaker is measured and delay is applied so sound coming from all speakers is precisely synchronized at the mix position. This feature is advantageously used in surround sound applications where space limitations prevent optimum speaker placement. If for example, the center speaker or surround speakers are placed to close mix position, delay is applied so sound arriving from these speakers is in synch with sound from the furthest speaker on the network.

(6) dBFS Meters—A meter may be placed on the front of the speaker and calibrated to indicate the output in dBs below the speaker's full output capability. By measuring at the listening position using a Sound Pressure Level (SPL) meter, the system can be calibrated so that the meter displays how much SPL is contributed by the speaker. For example, when the meter turns a specific color, such as yellow (the $25^{th}$ segment is illuminated), it may indicate that the speaker is contributing 85 dB SPL at the mix position.

The self-calibration functions 526 in the loudspeaker control system 500 in FIG. 5 execute when the loudspeaker is being calibrated as a single speaker. The self-calibration functions 526 may be similar to the self-calibration functions described above with reference to FIG. 3. The speaker external control functions 528 include functions that execute when another speaker on the network operates as a master to calibrate the object speaker (i.e. the speaker controlled by the loudspeaker control system 500 in FIG. 5). Such functions include:

(1) Identifying the speaker: In response to a scan of speakers by the master speaker, the object speaker reads the dipswitch setting, or other identifier setting, and sends the identifier to the master speaker.

(2) Initiate a calibration: The object speaker may execute a function of initiating a calibration by generating a reference signal for the room mode correction process or the virtual positioning process.

(3) Receive digital filter settings and configure digital filters: The object speaker receives settings for the digital filters from the master and uses the settings to configure the digital filters.

(4) Receive and Set a signal delay: The object speaker may receive a signal delay command from the master during a virtual positioning process.

(5) Receives and set speaker trim—the object speaker may receive a command to attenuate its level relative to other speakers on the network Those of ordinary skill in the art will appreciate that the list of functions herein for both the network calibration master control functions 524 and speaker external control functions 528 is not limiting and other functions may be included depending on the types of calibration functions being performed.

The meter display controller 529 sends signals to the meter display 545 that indicate which LED or LEDs to illuminate. The meter display controller 529 may receive data indicative of an acoustic power level, or an SPL level, or volume, or other type of parameter that may be of interest to the user. The meter display controller 529 may then convert the data to a signal that turns on a number of LEDs to reflect a level for that particular parameter. The meter display controller 529 may be implemented in software and output signals to the meter display driver in the meter display 545 to illuminate the LEDs.

The audio signal processor 530 may include an analog to digital converter 532, a DSP 534, a set of digital filters 536, and a digital to analog converter 538. The DSP 534 may be used to configure the digital filters 536 in response to the network calibration master control functions 524, the speaker external control functions 528, and the self-calibration functions 526. The audio interface 550 includes crossover networks and amplifiers used to drive the speakers 560, 570.

Figure 6:
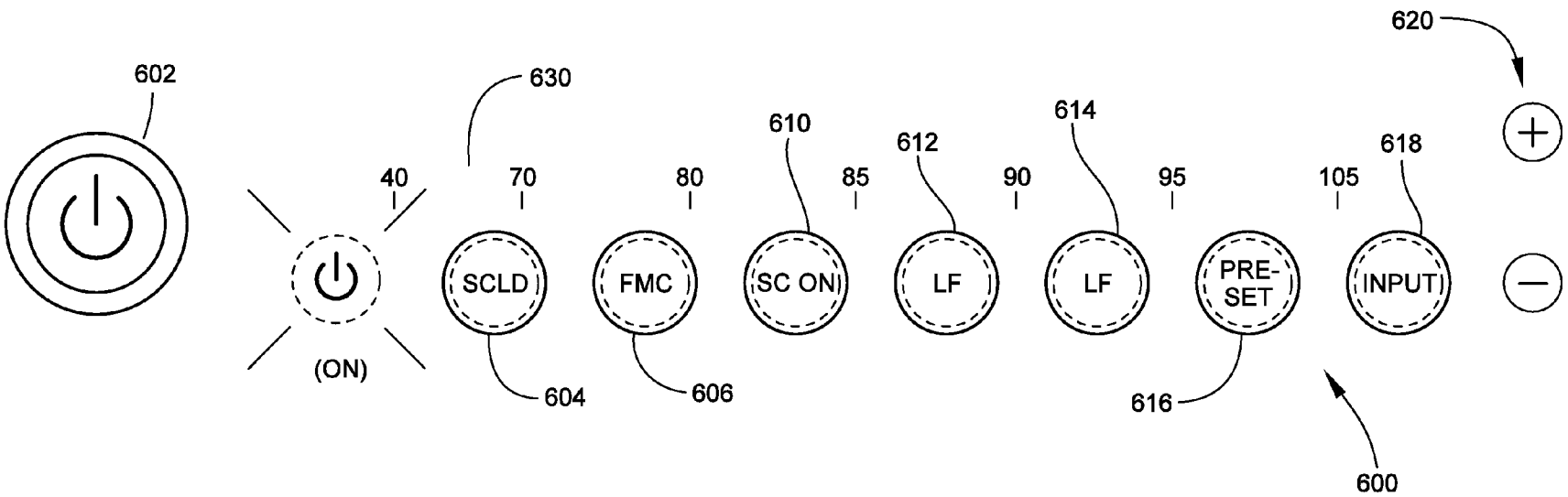
FIG. 6 is a diagram of a front panel control and display that may be used in any of the loudspeakers in FIG. 4A.

As described above, the speakers may include a variety of functions that may be accessed and controlled through an interface mechanism, such as buttons and switches, located on each speaker. In one example, a loudspeaker may include a front panel 600 as shown in FIG. 6. The front panel 600 may include, but not be limited to, (i) a power switch 602; (ii) an interface that mutes all other system speaker 604; (iii) an interface that initiates a calibration process 606; (iv) an interface that bypasses any calibration settings 608; (v) an interface that activates user equalization in the system (which may, for example, offer +/−2 dB of high and low frequency equalization in ¼ dB steps) 610; (vi) an interface for modifying low frequency user-EQ settings 612; (vii) an interface for modifying high frequency user-EQ settings 614; (viii) an interface capable of recalling factory presets and/or custom presets 616; (ix) an interface that changes input selection 618; and (x) a control interface 620 shown as '+' and '−' buttons, which may be used as a volume control for increasing or decreasing the volume of the speaker or all speakers in the system. The control interface 620 may also be used for increasing or decreasing, and for toggling through settings of a selected function, such as LF EQ, HF EQ, preset number, and input source selection. The control interface 620 may also be used for increasing and decreasing the brightness of the LED display and front panel buttons.

Each speaker may also include a meter display 630, such as a LED display or mechanical indicator that may be positioned, for example, on the front of the loudspeaker or other location on the speaker. The meter 630 may be calibrated to indicate current settings of the speaker, the current status of the speaker, current performance characteristics of the loudspeaker, including, but not limited to output and/or acoustical power of the speaker, and/or the speaker's contribution to the system at the mixing or listening position, including, but not limited to, the electrical or acoustical sound pressure level (SPL) of the speaker. The meter display 630 may be controlled by the meter display controller 529 shown in FIG. 5, for example, under control of a CPU to reflect a level of a parameter that is meaningful to the user. The meter display 630 may include a color-coding scheme corresponding to different operational levels. The meter display 630 may be used to represent a threshold value corresponding to the maximum output of the speaker and/or other predefined output level. The meter display 630 may indicate the operational levels of the speaker within any predefined range, which may include, but not be limited to, the audio dynamic range of the speaker. The meter display 630 may indicate different performance measurements, including, but not limited to output in SPL, measured at the mix position, or dB/dBFS ("dB Full Scale"). The meter display 630 can also indicate settings of system parameters including but not limited to amount of equalization, volume control setting, currently selected input, currently selected preset, progress of the RMC calibration process, software version number and the setting for illumination level.

All or a select number of individual speaker settings and/or system settings, such as global volume control, could also be adjusted by either, or both, a remote control system or a software control system. A software control system may be designed to include a virtual monitor section that resembles a monitoring section on a mixing console. The control system may further be capable of saving complete system configurations and system settings for specific locations or projects or listening positions. Accordingly, coordinated control of the entire system may be provided through each speaker, via hand-held remote control system and/or computer software.

When used in connection with a control system, the control system may be designed to poll the system to determine the number of speakers in the system and the relative position of each speaker in the system. The relative position of each speaker may be determined, for example, through the positioning of dip switches on each loudspeaker. Using this information, the control system may automatically produce and display a "virtual" image of the system without any input from the user. Further, adjustments, measurements and/or calculations recorded, generated and/or implemented during system calibration can be sent to, or retrieved by, the control system. The control system can then display this data to the user and/or can store the data for subsequent recall.

The loudspeaker system can be designed and configured for a variety of applications, ranging from simple stereo mixing to complex surround production using, for example, eight main speakers in any desired mix of models, e.g., 6" and 8", and two subwoofers. A system configured to include a subwoofer may also provide professional bass management of the main channels, LFE (low frequency effects) input, adjustable crossover points and/or features for surround production.

Each speaker may also include reinforced mounting points to provide convenient positioning and installation of multichannel surround systems for any mixing application, in any environment.

The controls and indicators on the front panel shown in FIG. 6 are optional. In a fully software controlled system, all of the controls available on the front panel as described with reference to FIG. 6 may be implemented by a software program running in a workstation connected to the speakers via a USB cable, for example.

Figure 7:
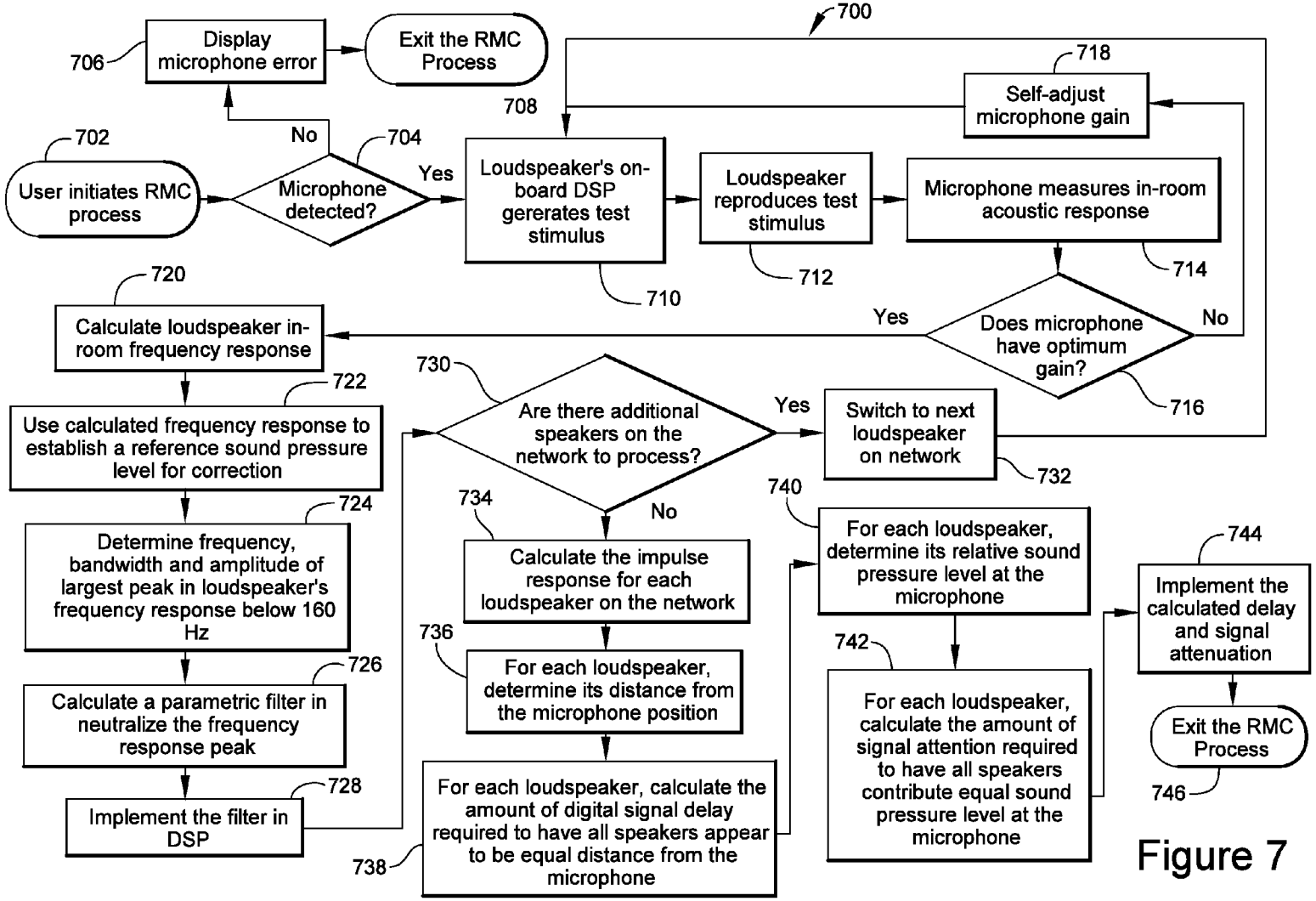
FIG. 7 is a flowchart of a method for configuring an example system of self-calibrating loudspeakers for operation in a room.

FIG. 7 is a flowchart of an example of a method 700 for performing room mode correction in a network of speakers. In the example in FIG. 7, one speaker in the network is the master speaker that performs the digital signal processing and system control. The master speaker is the speaker to which the microphone is connected. The method 700 begins at step 702 when a user initiates the process. The process may be initiated by the press of a button on the master speaker, or by remote control, using computer control software, or by any other suitable means. Once the process is initiated, a test is initiated at decision block 704 to sense a microphone at the master speaker. If a microphone is not detected, a microphone error is displayed on the front panel, or by some other suitable means as shown at step 706, and the method stops at step 708. If a microphone is detected, the master loudspeaker begins a process that it will repeat for each loudspeaker in the network of loudspeakers. The master loudspeaker first generates a test signal at step 710 from its control system. The test signal may be generated using a function controlled by the DSP in the master loudspeaker. The master loudspeaker then reproduces the test signal at step 712 for the microphone to pick up to measure the in room acoustic response at step 714. At decision block 716, a check is made of the microphone to determine if the gain is adequate for the calibration process. If the gain is inadequate, the microphone performs a self-adjustment of its gain at step 718. The master speaker then generates the test signal again until an optimum gain is measured at the test performed as part of decision block 716. The process of ensuring an optimum gain from the microphone may be repeated before calibrating each loudspeaker in the network as shown in FIG. 7.

The steps that follow are performed by the master loudspeaker for each loudspeaker in the network. Once an optimum gain is measured for the microphone, the master loudspeaker calculates the in-room frequency response for the loudspeaker that is the subject of the calibration process at step 720. The calculated frequency response is then used to establish a reference sound pressure level for the speaker at step 722. At step 724, the loudspeaker analyzes the frequency response to determine the frequency, bandwidth, and amplitude of the largest peak in the frequency response below some low frequency threshold, such as about 160 Hz. Step 724 may involve searching for multiple peaks. For example, the frequency response data may be scanned from one frequency to another frequency to identify a center frequency, a Q value, and an amplitude and a peak. The samples around the center frequency may be analyzed to determine a lower frequency at the low end of the Q, and a high frequency at the high end of the Q. This information may then be used to determine the parameters used in a digital filter to correct for the peak. For example, at step 726, the master loudspeaker uses the information obtained in step 724 to calculate a parametric filter that is designed to neutralize the detected frequency response peak. Steps 724 and 726 may be performed multiple times to seek multiple peaks that may have been generated by room modes or boundary conditions. A parametric filter may be configured at 726 for each peak found in step 724. In one example of the method, a step may be added to combine filters if peaks are found to be with a certain frequency range. At step 728, the parametric filter is implemented in the subject loudspeaker. At decision block 730, the master loudspeaker checks whether there are additional speakers to calibrate for room modes. If so, the master loudspeaker switches to the next loudspeaker in the network at step 732 and proceeds to check the microphone gain at steps 710-716. Once the microphone gain is optimal, the master loudspeaker proceeds to perform the room mode correction for the next loudspeaker at steps 720-728.

More than one microphone may be used to obtain sweeps of data. Or, alternatively, multiple sweeps of data my be performed with a single microphone. The sweeps of data may then be averaged to obtain spatial averaging of the data.

If at decision block 730, the master loudspeaker concludes that it has reached the last loudspeaker in the network, the master loudspeaker proceeds to step 734 to calculate the impulse response for each loudspeaker in the network. At step 736, the master loudspeaker calculates for each loudspeaker in the network, the distance between the loudspeaker and the microphone.

In step 734, calculation of the impulse response may include, in one example, taking a "sweep" of data by generating a spectrum of tones starting at one end of a selected frequency range to another end. The microphone picks up the tones. The control circuitry in the loudspeaker (such as the system described above with reference to FIG. 5), may then receive the sweep, convert it to digital form by sampling it, and storing it in memory. The control circuitry would store the actual signal output in one area of memory, and the signal received in the sweep at the microphone in another area of memory. The impulse response may then be calculated by dividing the actual signal output data by the data of the signal received at the microphone. At step 738, the master loudspeaker then calculates the amount of digital signal delay each speaker would need to inject in the signal to make all the speakers sound as though they were equidistant from the microphone. This signal delay may be calculated by counting the samples between a peak that would appear in both the data of the signal output and the data of the signal received at the microphone. The number of samples between the relative locations of the peaks may then be divided by the sampling rate of the analog to digital converter.

At step 740, the master loudspeaker then calculates the relative sound pressure level at the microphone for each speaker. Steps 734, 736 and 740 may be performed just before step 720 as part of the processes performed for each loudspeaker in the system. Steps 738 and 742 may then be performed after the delays and relative SPLs of all of the speakers have been calculated. At step 742, the master loudspeaker uses the relative sound pressure level at the microphone for each speaker to determine the extent to which the signal at each speaker should be attenuated to have all of the speakers contribute equal sound pressure level at the microphone. At step 744, the master loudspeaker communicates with each loudspeaker in the network and implements the calculated signal delay and attenuation calculated at steps 738 and 742. The process then exits at step 746.

One skilled in the art will appreciate that all or part of systems and methods consistent with the present invention may be stored on or read from any machine-readable media, for example, secondary storage devices such as hard disks, floppy disks, and CD-ROMs; a signal received from a network; or other forms of ROM or RAM either currently known or later developed. The memory may be located in a separate computer, in the loudspeaker, or both.

The foregoing description of an implementation has been presented for purposes of illustration and description. It is not exhaustive and does not limit the claimed inventions to the precise form disclosed. Modifications and variations are possible in light of the above description or may be acquired from practicing the invention. For example, the described implementation includes software but the invention may be implemented as a combination of hardware and software or in hardware alone. Note also that the implementation may vary between systems. The claims and their equivalents define the scope of the invention.

The invention claimed is:

1. A loudspeaker comprising:

at least one speaker;

at least one audio input to receive an audio signal;

at least one microphone input to connect to at least one microphone;

a loudspeaker control system, mounted in the loudspeaker, the loudspeaker control system having an audio signal processor to process the at least one audio signal, the audio signal processor being configurable to adjust sound characteristics of the speaker; and the loudspeaker control system including a self-calibration function to perform with the at least one microphone in a selected listening area in a room, the self-calibration function operable to generate a test sound via the at least one speaker for pickup by the at least one microphone and to analyze a test signal received by the at least one microphone to determine at least one sound effect caused by the room at the listening area, and to configure the audio signal processor to compensate for the sound effects caused by the room by adjusting the sound characteristics of the speaker, where the self-calibration function includes a room mode correction function that analyzes the test signal by determining a frequency response, analyzes the frequency response at a low frequency range below a selected frequency to identify any room modes, and generates parameters for a digital filter to compensate for the room modes.

2. The loudspeaker of claim 1 further comprising:

a calibration initiation input to initiate execution of the self-calibration function.

3. The loudspeaker of claim 2 where the calibration initiation input includes a pushbutton mounted on the loudspeaker.

4. The loudspeaker of claim 2 where the calibration initiation input includes a wireless remote receiver to receive a signal to initiate execution of the self-calibration function.

5. The loudspeaker of claim 1 further comprising:

a network interface to form a communication link to at least one other loudspeaker in a loudspeaker network, each of the loudspeaker and the at least one other loudspeaker being uniquely identified in the loudspeaker network by a unique identifier; and a network calibration controller configured to identify each loudspeaker in the loudspeaker network based on the unique identifier, and configured to coordinate control of the loudspeaker network, and at least one calibration function for each loudspeaker in accordance with a respective unique identifier.

6. The loudspeaker of claim 5 where the at least one calibration function includes a room mode correction function that analyzes the test signal by determining a frequency response, analyzing the frequency response at a low frequency range below a selected frequency to identify any room modes, and generating parameters for a digital filter to compensate for the room modes; and where the network calibration controller performs the room mode correction function for each speaker.

7. The loudspeaker of claim 5 where the at least one calibration function includes a speaker positioning function to calculate a distance from the at least one microphone for each loudspeaker, to calculate a digital signal delay for each loudspeaker to use to sound as though the loudspeakers in the loudspeaker network were equidistant to the microphone.

8. The loudspeaker of claim 5 where the at least one calibration function includes a sound pressure equalization function to determine a relative sound pressure level at the microphone for each loudspeaker, and to calculate a signal attenuation to use to have all loudspeakers contribute equal sound pressure level at the microphone.

9. A system for calibrating a loudspeaker comprising:

at least one microphone input to connect to at least one microphone; and a loudspeaker control system mounted in the loudspeaker, the loudspeaker control system having an audio signal processor configurable to adjust sound characteristics of the loudspeaker, and a self-calibration function to perform with the microphone in a selected listening area in a room, the self-calibration function operable to generate a test sound via the loudspeaker for pickup by the microphone and to analyze a test signal received by the microphone in response to the test sound to determine at least one sound effect caused by the room at the listening area, and to configure the audio signal processor to compensate for the sound effects caused by the room by adjusting the sound characteristics of the loudspeaker, where the self-calibration function includes a room mode correction function that analyzes the test signal by determining a frequency response, analyzes the frequency response at a low frequency range below a selected frequency to identify any room modes, and generates parameters for a digital filter to compensate for the room modes.

10. The system of claim 9 further comprising:

calibration initiation input to initiate execution of the self-calibration function.

11. The system of claim 10 where the calibration initiation input includes a pushbutton mounted on the loudspeaker.

12. The system of claim 10 where the calibration initiation input includes a wireless remote receiver to receive a signal to initiate execution of the self-calibration function.

13. The system of claim 9 further comprising:

a network interface to connect to at least one other loudspeaker in a loudspeaker network; and a network calibration controller to identify each loudspeaker in the loudspeaker network and to perform at least one calibration function for each loudspeaker.

14. The system of claim 13 where the at least one calibration function includes a room mode correction function that analyzes the test signal by determining a frequency response, analyzing the frequency response at a low frequency range below a selected frequency to identify any room modes, and generating parameters for a digital filter to compensate for the room modes; and where the network calibration controller performs the room mode correction function for each loudspeaker.

15. The system of claim 13 where the at least one calibration function includes a speaker positioning function to calculate a distance from the microphone for each loudspeaker, to calculate a digital signal delay for each loudspeaker to use to sound as though the loudspeakers in the loudspeaker network were equidistant to the microphone.

16. The loudspeaker of claim 13 where the at least one calibration function includes a sound pressure equalization function to determine a relative sound pressure level at the microphone for each loudspeaker, and to calculate a signal attenuation to use to have all loudspeakers contribute equal sound pressure level at the microphone.

17. A method for calibrating a loudspeaker comprising:

connecting a microphone to the loudspeaker;

placing the microphone in a listening area in a room;

generating a test sound with the loudspeaker and receiving a test signal at the microphone in response to the test sound;

processing the test signal within the loudspeaker by:

determining a frequency response representing a sound effect caused by the room at the listening area;

analyzing the frequency response at a low frequency range below a selected frequency to identify any room modes; and generating parameters for a digital filter to compensate for the room modes; and configuring the loudspeaker with the digital filter to compensate for the sound effects caused by the room by adjusting the sound characteristics of the loudspeaker.

18. The method of claim 17 further comprising initiating a self-calibration function before the step of generating the test sound.

19. The method of claim 18 where the step of initiating the self-calibration function includes the step of pressing a pushbutton mounted on the speaker.

20. The method of claim 17 further comprising: connecting the loudspeaker to at least one other loudspeaker in a loudspeaker network; identifying each loudspeaker in the loudspeaker network; and performing at least one calibration function for each loudspeaker.

21. The method of claim 17 where the at least one calibration function includes a method comprising:

for each loudspeaker, emitting a test sound for pickup by the microphone;

determining a frequency response of each loudspeaker from the test signal picked up by the microphone for each loudspeaker;

analyzing the frequency response at a low frequency range below a selected frequency to identify any room modes generated by the test sound from each loudspeaker in the room; and generating parameters for a digital filter in each loudspeaker to compensate for the room modes.

22. The method of claim 17 further comprising a method comprising:

calculating a distance from the microphone to each loudspeaker;

calculating a digital signal delay for each loudspeaker to use to sound as though the loudspeakers in the loudspeaker network were equidistant to the microphone; and inserting the digital signal delay for each loudspeaker into audio signals to each corresponding loudspeaker.

23. The method of claim 17 further comprising a method comprising:

determining a relative sound pressure level at the microphone for each loudspeaker; and calculating a signal attenuation to use in each loudspeaker to have all loudspeakers contribute equal sound pressure level at the microphone.

* * * * *